US007185379B2

(12) United States Patent
Barman

(10) Patent No.: US 7,185,379 B2
(45) **Date of Patent: *Mar. 6, 2007**

(54) FOAM ENCASED INNERSPRING WITH INTERNAL FOAM COMPONENTS (TRIPLE CASE)

(75) Inventor: Bruce G. Barman, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 128 days.

This patent is subject to a terminal disclaimer.

(21) Appl. No.: 10/686,823

(22) Filed: Oct. 16, 2003

(65) Prior Publication Data

US 2005/0039264 A1 Feb. 24, 2005

Related U.S. Application Data

(63) Continuation-in-part of application No. 10/402,612, filed on Mar. 28, 2003, now Pat. No. 7,082,635.

(60) Provisional application No. 60/511,849, filed on Oct. 15, 2003.

(51) Int. Cl.
*A47C 23/04* (2006.01)

(52) U.S. Cl. ..... 5/717; 5/721

(58) Field of Classification Search ..... 5/716–721, 5/654.1, 655.9, 655.7, 642
See application file for complete search history.

(56) References Cited

U.S. PATENT DOCUMENTS 1,906,893 A * 5/1933 Young et al. ..... 5/716
2,408,382 A 10/1946 Dubick
2,826,769 A 3/1958 Drews
2,940,089 A 6/1960 Koenigsberg
3,010,122 A * 11/1961 Koenigsberg ..... 5/721
3,100,305 A 8/1963 Kaye
3,262,135 A 7/1966 Fasanella
3,618,146 A 11/1971 Ferdinand
3,848,283 A 11/1974 Ikeda
4,067,076 A 1/1978 Krier
4,075,721 A 2/1978 Autrey
4,286,344 A 9/1981 Ikeda
4,650,251 A 3/1987 Shimada
4,677,701 A 7/1987 Galumbeck
4,686,725 A 8/1987 Mitchell
4,907,309 A 3/1990 Breckle
5,040,255 A * 8/1991 Barber, Jr. ..... 5/720

(Continued)

FOREIGN PATENT DOCUMENTS

FR 780450 4/1935

*Primary Examiner*—Sunil Singh
(74) *Attorney, Agent, or Firm*—Roetzel & Andress

(57) ABSTRACT

A molded foam-encased integrated flexible support device includes an innerspring positioned upon a three-dimensional thermoplastic foam deck as a flexible foundation, and a molded foam encasement which structurally integrates the foam deck with the innerspring by attachment to perimeter coils of the innerspring. A sculpted foam topper is adhesively bonded to a support surface of the foam-encased innerspring, forming a unitized mattress or support structure with fully integrated innerspring and internal and external foam components. The sculpted foam topper is designed with varying contours and densities to provide the desired support and feel characteristics for different comfort profiles. The foam encased innerspring with internal three-dimensional foam structures is upholstered for use as a mattress, seating, or other flexible support structure.

41 Claims, 4 Drawing Sheets

U.S. PATENT DOCUMENTS 5,048,167 A 9/1991 Heffley et al.
5,133,116 A 7/1992 Wagner et al.
5,210,890 A 5/1993 Hagglund
5,239,715 A 8/1993 Wagner
5,467,488 A 11/1995 Wagner
5,469,590 A 11/1995 Simon
5,537,699 A 7/1996 Bonaddio et al.
5,687,439 A 11/1997 Wagner
5,724,686 A 3/1998 Neal
5,787,532 A 8/1998 Langer et al.
6,023,803 A 2/2000 Barman
6,041,459 A 3/2000 Nunez et al.
6,128,798 A 10/2000 Barman et al.
6,263,533 B1 7/2001 Dimitry et al.
6,306,235 B1 10/2001 Henderson

* cited by examiner

FOAM ENCASED INNERSPRING WITH INTERNAL FOAM COMPONENTS (TRIPLE CASE)

RELATED APPLICATIONS

This application claims the benefit of provisional U.S. application Ser. No. 60/511,849 filed Oct. 15, 2003, and is a continuation-in-part of U.S. application Ser. No. 10/402,612, now U.S. Pat. No. 7,082,635 filed Mar. 28, 2003.

FIELD OF THE INVENTION

The present invention pertains generally to mattresses and mattress innersprings and; more particularly, to mattresses which include both wire-form innersprings and structural foam components.

BACKGROUND OF THE INVENTION

Foam components are commonly combined with wire or steel form innersprings in mattress, seating and other flexible support structures. Early versions included foam layers which were either attached directly to a wire innerspring or simply held in position by overlying upholstery. Smaller foam components are designed to fit within spaces of the innerspring. As described in the referenced related application, a new approach to the integration of innersprings and foam components involves welding or bonding of mating foam components to form a unibody structure which fits with an innerspring, forming a unitized steel and foam structure which provides flexible support.

Different types of foam and foam parts have been used extensively in seating and bedding as flexible support material. Semi-rigid open and closed cell foams of polyethylene, polyurethane or polystyrene have been used in combination with other components and load-bearing structures, such as wire form innersprings and framing to form flexible supports, such as described in U.S. Pat. Nos. 5,048,167; 5,469,590; 5,467,488 and 5,537,699 and 5,787,532. In most of these spring support products, the foam pieces surround or interfit with spring elements, and rely on mechanical connection with the spring elements to keep the foam pieces in place. Foam pieces have also been adhesively bonded and combined with innersprings. The types of foams used in these applications are typically open-cell polyurethane and latex materials, which can be effectively bonded by compatible adhesives. The open-cell structure of these types of foams results in easier compression or lower ILD which is suitable for many bedding and seating applications, particularly for support surface or topper layers underneath upholstery. They are not generally utilized as structural members in a mattress or support cushion in seating. Also, polyurethane and other non-thermoplastic type foams cannot be bonded or welded by any heat-source process due to their decomposition properties.

Some foam shapes have been used integrally with springs to augment or otherwise support metal spring structures, as shown for example in U.S. Pat. Nos. 5,133,116; 5,239,715; 5,467,488 and 5,687,439. Because this type of use of foam relies on the surrounding metal structure to hold it in place, the foam itself is not in the form of a unitized three-dimensional support structure with its own load-bearing capacity.

Another use of foam in connection with an innerspring is disclosed in U.S. Pat. No. 5,787,532, wherein an extruded foam piece is used as a perimeter wall to an innerspring, with fingers which mechanically engage the coils of the innerspring. While this provides vertical support at the perimeter of the innerspring, it relies on mechanical attachment to the innerspring for the correct orientation. It also only provides support primarily in the vertical direction and does nothing to stabilize the innerspring in the lateral or horizontal directions.

One type of foam which has been used for these types of applications is closed-cell polyethylene foam which is molded or extruded by known processes into desired shapes. Closed-cell foam has greater support properties due to the fact that each closed cell contains a gas which maintains the cells in an inflated state when under compression, as compared to open-cell foams from which a substantial volume of air is displaced when compressed.

Latex and polyethylene foam is commonly used in slab form as cushioning or dampening layers in mattresses and seating, held in place relative to an innerspring simply by surrounding upholstery. Alternatively, latex foam can be readily molded, and has been molded about innersprings to form a foam-encased mattress. This type of combination of foam and innerspring does not include any internal foam components which provide three-dimensional flexible, or which are bonded to any other components of a mattress or other flexible support device.

SUMMARY OF THE PRESENT INVENTION

The present invention provides a multiple component mattress or support structure which combines integrated foam materials and structures with an innerspring or other flexible core. An extruded polyolefin foam deck is used as an underlying flexible structural support and dampening foundation for an innerspring. An insulator pad, such as a thermally bonded, high-density, high quality polyester fiber pad is positioned over an opposing side of the innerspring opposite the foam deck. A foam encasement, such as a molded polymerizing reaction mixture, structurally integrates the foam deck, innerspring and insulator pad by bonding to perimeter areas of the foam deck and insulator pad, and to perimeter coils or spring elements of the innerspring, creating a fully integrated unibody assembly. The foam encasement forms an exterior wall about the perimeter of the innerspring and foam deck and structurally integrates these components. A sculpted foam topper is then positioned over the insulator pad on a support surface of the innerspring opposite the foam deck, preferably with surface design features sculpted in the support side of the topper. The further combination of the foam topper, by adhesive bonding to the insulator pad, the three different foam structures of the foam deck, foam encasement and foam topper, and a flexible core such as the innerspring or solid block of foam, creates a highly variable and tunable support system.

A foam deck which can be used in accordance with the invention is preferably a structural extruded foam, such as closed-cell polyolefin, which may be thermally bonded to form the described three-dimensional deck structures as described in the related application, incorporated herein by reference. In a preferred embodiment, the foam deck is formed by a plurality of extruded foam beams which are bonded or fused together by welds along abutting edges. The foam is preferably thermoplastic in behavior, being able to reversibly melt and solidify without decomposing. In one embodiment of the invention, a thermally bonded unitized three-dimensional foam structure is combined with another support element, such as an innerspring, to provide a flexible support structure which is at least partially encapsulated in foam, such as polyurethane foam or other resilient polymer molded about a perimeter of the foam deck and innerspring. The thermoplastic foam structure of the foam deck dampens and softens the feel of the innerspring, and provides edge support and stability, and a protective cover for the underside of the innerspring. It also provides a foundational slab to which walls of the foam encasement attaches. In a preferred embodiment, the thermoplastic foam components or pieces are made of extruded foam, such as gas-blown polyethylene, in a box beam or slab form. The vertical profile of the box beams of the foam deck defines a degree of stiffness and flexure which responds to localized loads on the overlying innerspring. The foam encapsulation of the innerspring and foam deck forms side walls to the mattress which are structurally integrated with the foam deck, innerspring and insulator pad opposite the foam deck. The side walls provide vertical support, and form a smooth unitized body ideally configured for neat application of upholstery. The use of a foam topper in combination with the foam encased innerspring increases the support density of the edge areas of the mattress, and allows for customization of the comfort profile by sculpting of the primary support surface.

These and other preferred and alternate features and advantages of the present invention are described herein with reference to the accompanying Figures which illustrate a representative physical form of the inventive concepts.

DETAILED DESCRIPTION OF PREFERRED AND ALTERNATE EMBODIMENTS

Figure 1:
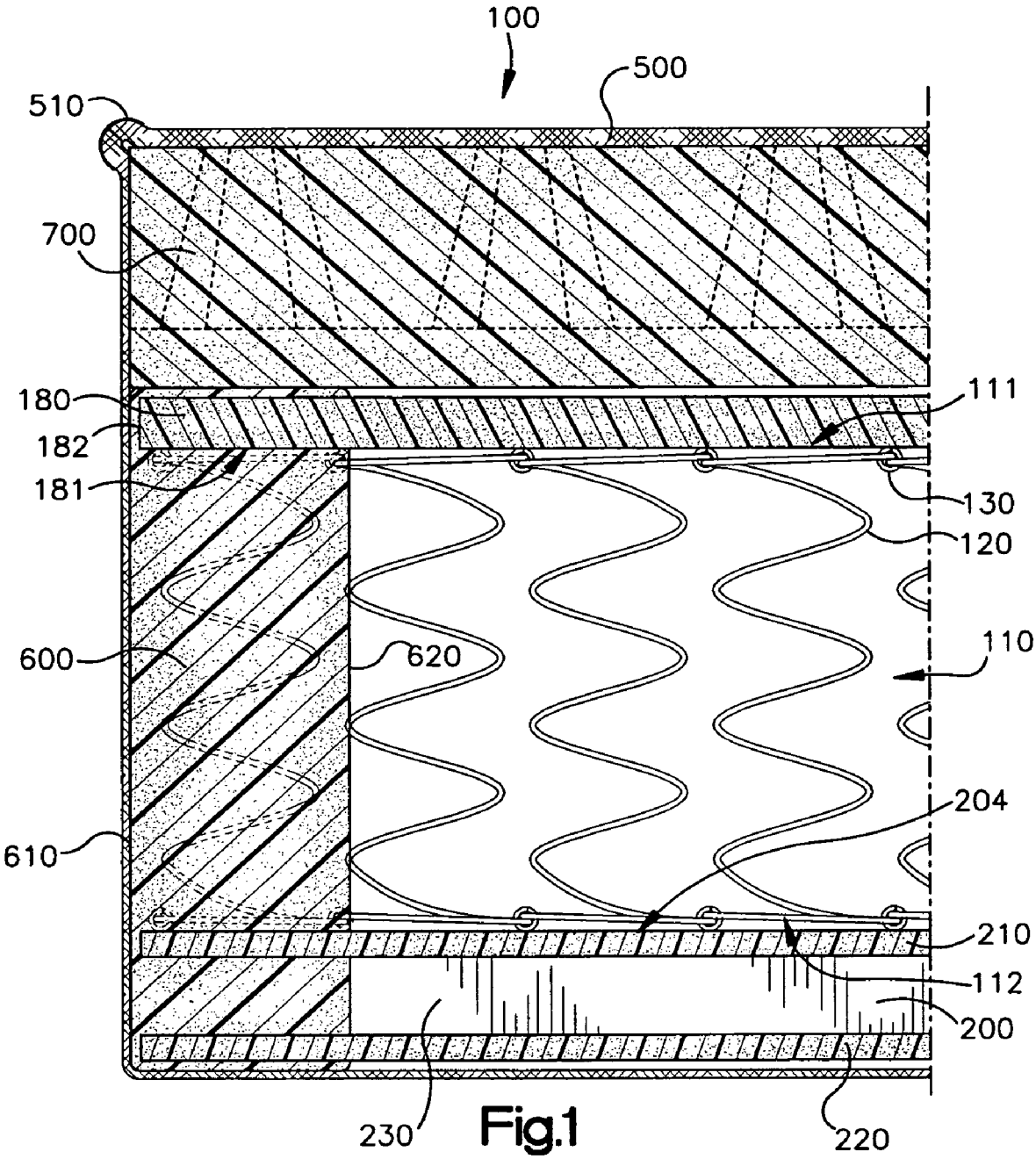
FIG. 1 is a cross-sectional view of a structurally integrated foam encased support device with an innerspring and internal foam components in accordance with the invention.
Figure 2:
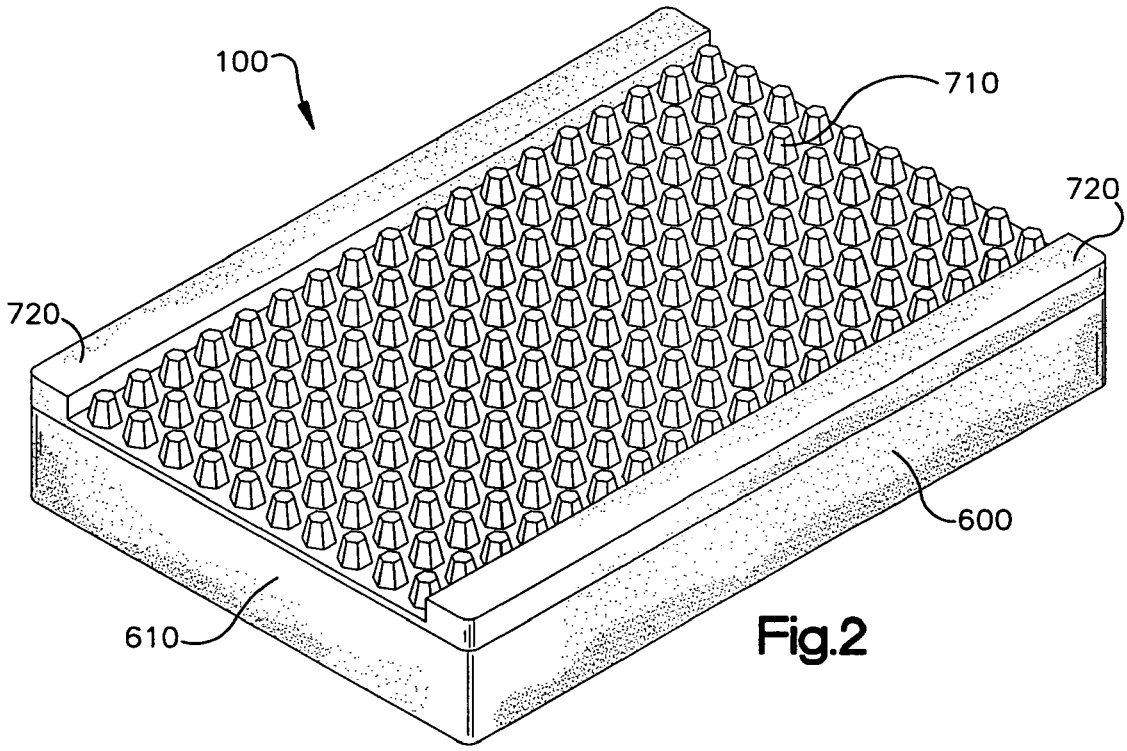
FIG. 2 is a perspective view of a structurally integrated foam encased support device with an innerspring and internal foam components with a sculpted foam topper, in accordance with the invention.

With reference to FIG. 1, there is illustrated a structurally integrated foam encased support device, referenced generally as 100, which in this particular embodiment of the invention is in the form of a one-sided mattress, as further described. The device 100 includes an innerspring and internal and external foam components. The innerspring 110 (also sometimes referred to herein as an "innerspring assembly") is made up of a plurality of wire form coils 120 which are interconnected or laced together by helical wires 130 as known in the art, in an array to form an assembly which has a first support side generally defined by aligned first ends of the coils or spring elements, and a second support side generally defined by the aligned second ends of the coils or spring elements, the first and second support sides being parallel, and a perimeter about the first and second support sides defined by perimeter coils at the edges of the array, defining a generally rectangular shape to the innerspring assembly. The innerspring 110 has first and second support surfaces 111 and 112, and lateral edges 113 and 114 defining a generally rectangular spring form which can be dimensioned to conventional or traditional mattress sizes, or in other shapes or sizes for use in specialty mattresses for aircraft or watercraft, or seating and furniture applications.

Although illustrated with this type of wire form interconnected innerspring, the invention is equally applicable to all types of innersprings and innerspring assemblies, regardless of the form of the individual coils and the manner of interconnection of the coils, and including such variants as Marshall type pocketed coils and coils made of materials other than steel spring wire. The invention is also highly adaptable for use with other types of reflexive bodies or flexible cores which may be used in place of traditional innersprings having individual coils or spring elements. Some examples of other types of innersprings which may be used in combination with the unitized foam structures include: wire-form innersprings of any variety such as Bonnel or other helical designs, continuous wire-form designs which do not have individual helical coils, interconnected springs or coils made of plastic or composite materials, pocketed or Marshall-type coils held in an array by material which is sewn or bonded, and solid blocks of material such as latex foam or other suitable foams or layers of foam (referred to herein as a "flexible core") shown as block 190 in FIG. 5, or gas or water or any other type of reflexive body or mass.

Figure 3A:
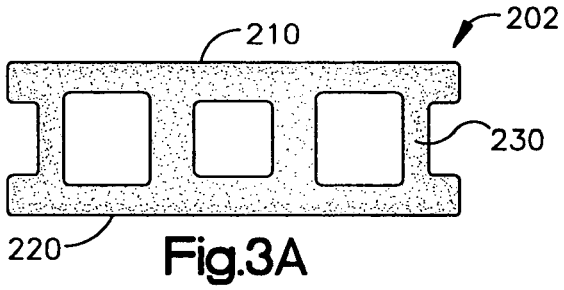
FIGS. 3A, 3B and 3C are cross-sectional views of alternate embodiments of a segment of a foam deck component of the invention.
Figure 3B:
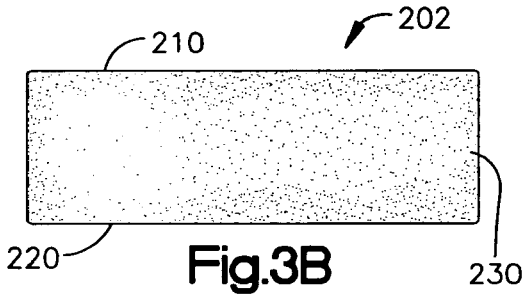
Figure 3C:
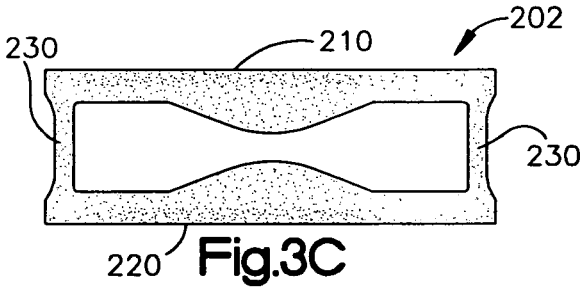

One form of an internal foam component used with the invention is in the form of a foam deck, indicated generally at 200, which is positioned adjacent to the innerspring 110, for example underlying or proximate to support surface 112. The foam deck 200 is preferably formed of extruded foam box beams 202 of the type illustrated in the cross-sectional views of FIGS. 3A–3C, but may alternatively be simply a foam sheet or slab with first and second sides 210, 220, as shown. In the box beam form, the foam deck 200 has a first panel 210 and a second panel 220 which is parallel to and spaced from panel 210, and held in this arrangement by a structure between the panels 210, 220, such as webs 230, which may be in any form which spans between the panels across the gap between the panels. The extent of the gap or spacing between the panels 210, 220 can be designed according to desired properties, such as desired flexibility of the foam deck 200 and overall height dimension of the mattress. By changing the number, spacing and size of webs 230, the stiffness of the foam deck 200 can be altered. As the structure which underlies the innerspring 110 in a one-sided mattress, this in turn alters the stiffness or feel of the mattress, by altering the support response to compression of the innerspring. In other words, the stiffness of the foam deck 200 is transferred through the innerspring 110 to alter the overall feel of the mattress.

The foam deck 200 also serves as the structural and protective base of a one-sided mattress, as illustrated in FIGS. 1, 2, 4 and 5. The mattress upholstery or covering is applied over the bottom panel 220 as further described. Because the foam deck 200 has the multiple properties of the rigidity of threedimensional structure and the closed-cell foam matrix, along with flexibility and bendability, it provides a superior one-sided mattress which is both protected from the underside, and which has shock absorption and spring dampening of the innerspring from the bottom, non-support surface 112 of the innerspring 110. Also, because the foam deck 200 is flexible, even when thermally bonded or welded or attached or in contact with other foam components or materials as further described, it remains flexible with the innerspring 110.

Figure 4:
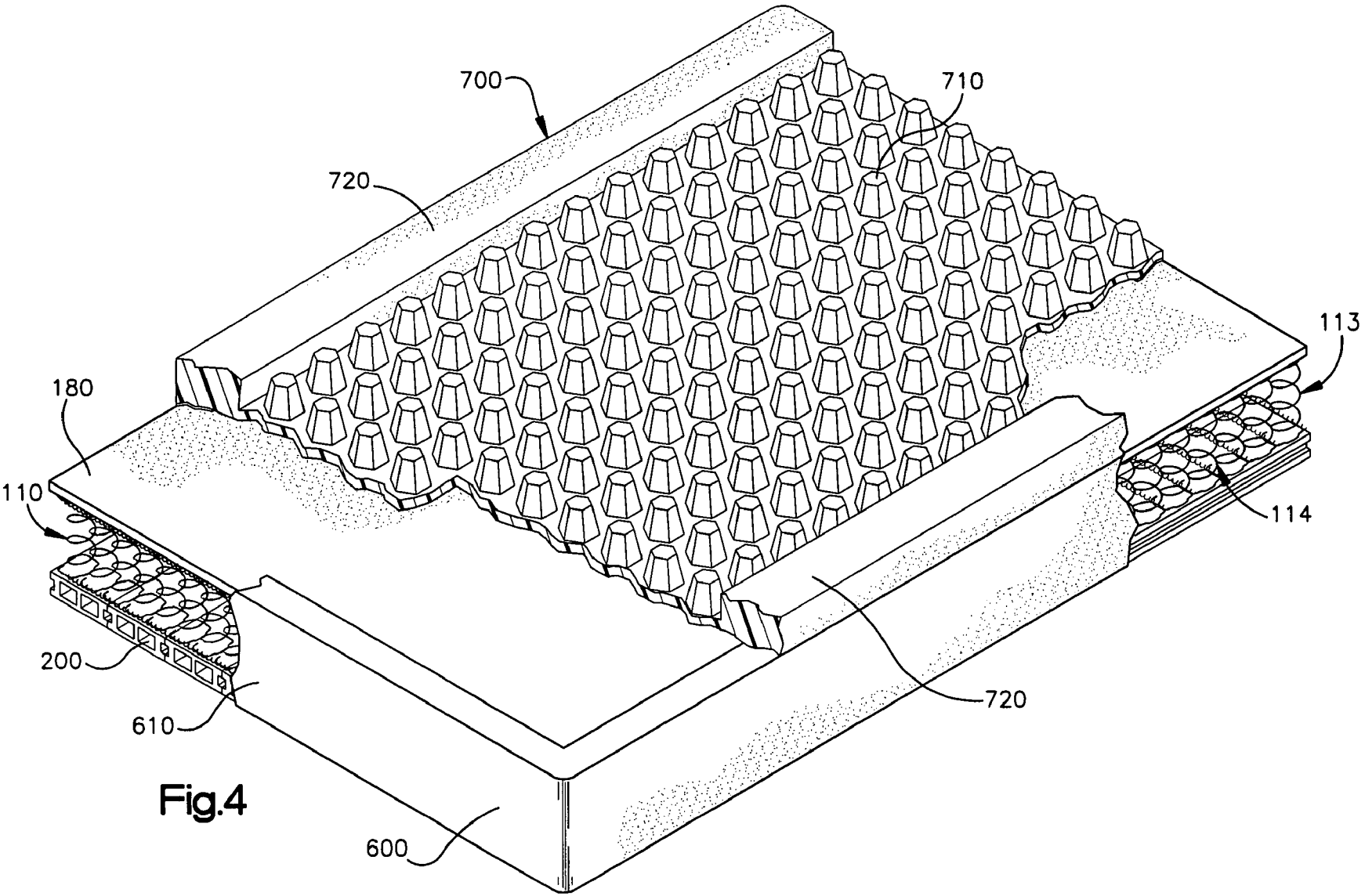
FIG. 4 is a perspective cutaway view of a structurally integrated foam encased support device of the invention.

To produce a box beam twin-panel version of the foam deck, multiple segments of box beams 202 can be bonded or fused together to form a major support surface 204 or a slab which is trimmed or cut to form a platform of the desired dimensions, which preferably corresponds to the innerspring 110. This type of construction of a foam deck 200 is shown in FIGS. 3 and 4, with the thermal weld or bond lines 203 indicated. One proprietary method of forming sheets of foam suitable for use as the deck 200 in the present invention is described in U.S. Pat. No. 6,306,235. This method is particularly suitable for forming a deck 200 of fused box beams 202 of various cross-sectional configurations, such as those shown in the Figures and others. These box beam design variations are used to compliment and tune a mattress or support structure of the invention with the spring characteristics of the innerspring to provide the desired mattress support and feel properties. Apart from this particular method of manufacture, box beams 202 of varying cross-sectional configurations can be combined in a single foam deck 200 for customized mattress properties. The fusing of the parallel edges of the beams 202 can be automated or by manual operation of a fusing or welding instrument such as an adhesive applicator or heat-knife welder. The beams may be arranged to run the length or width of the mattress, or diagonally or on a slight spiral relative to the innerspring.

The foam deck 200 performs several functions, including serving as a foundation or base for the innerspring 110 particularly when constructed as a one-sided mattress, providing dimensional stability to the innerspring in both the x and y directions (parallel to the surface) and providing a platform for formation of foam encasement about the innerspring, as further described. Use of the foam deck 200 underneath the innerspring 110 is advantageous over the conventional construction of one-sided mattresses which simply cover the bottom surface of the innerspring with a thin layer of material, leaving the underside of the innerspring unsupported and unprotected. The underlying foam deck 200 provides a soft, flexible foundation to the innerspring, and increases the overall height of the mattress without requiring any additional height to the innerspring.

As shown in FIGS. 1 and 4, opposed to the foam deck 200 across the height of the innerspring 110, on the opposite support surface of the innerspring 110, is placed a pad 180, such as a high-density, high quality polyester fiber pad such as Resilium™ made of thermally bonded polyester fibers, or alternatively made of polyurethane foam or other suitable material. The insulator pad 180 provides a contact surface over the underlying innerspring. As further described, the insulator pad 180 is structurally integrated with the foam deck 200 and innerspring 110 by encapsulation with a foam encasement formed of molded foam which contacts at least a perimeter area of pad 180. The three-part combination of the separate components of the foam deck 200, innerspring 110 and insulator pad 180 forms the internal structural components of the support device/mattress which are then permanently bonded together by foam encasement to structurally integrate the components together.

A foam encasement 600 is provided to structurally integrate the components of the foam deck 200, innerspring 10 and pad 180. In the embodiments shown in FIGS. 1, 4 and 5, the foam encasement 600 extends about the aligned perimeters of the foam deck 200 and innerspring 110, forming an exterior foam wall 610 to the mattress. An internal side 620 of the foam encasement 600 extends into or otherwise contacts the foam deck 200, the perimeter coils of the innerspring 110, and the peripheral edge of the pad 180. When the foam deck 200 is formed with the described spaced apart panels 210, 220 and webs 230 which extend between the panels, the internal side 620 of the foam encasement 600 extends into the openings between the panels and webs, forming an integral lock of the perimeter of the foam deck with the foam encasement 600. The internal side 620 of the foam encasement also extends into the perimeter of the innerspring 110, curing securely about and gripping the coils at the perimeter. This, in combination with the foam encasement extension into the gaps in the foam deck 200 forms an structural lock of the foam base 200 to the adjacent side of the innerspring 110.

To fully structurally integrate the foam encased innerspring of the invention, the foam encasement 600 also bonds or otherwise makes contact with the insulator pad 180, at least on an underside 181, and additionally at the edges 182 and partially extending over a top surface of insulator pad 180 as shown. This accurately secures the pad 180 in position on the support surface of the innerspring 110 without the use of any fasteners or other attachment device. It also keeps the insulator pad 180 in tight overlying arrangement with the innerspring so that the pad acts in unison with the innerspring and the foam deck foundation.

The exterior foam wall 610 of the foam encasement 600 forms a smooth and uniform wall to the entire integrated structure, over which padding and/or upholstery can be placed in a very smooth and tight manner to provide the mattress or support device with a highly finished appearance. This is particularly advantageous over other mattress designs which have no substructure at the perimeter other than coils over which upholstery is applied. The walls of the foam encasement 600 provide substantial vertical support at the perimeter of the mattress, effectively maximizing the useable surface area of the mattress.

A preferred method of forming the foam encasement 600 is by molding, preferably with a polymer foam reaction mixture in a fluid state, which can be injected into a mold in which the foam deck 200, innerspring 110 or flexible core and insulator pad 180 are placed in the described arrangement. In practice, for example, the three main components of the foam deck 200, innerspring 110 and foam topper 700 are aligned and placed in a mold which defines the exterior wall 610. The polymer foam reaction mixture is then introduced into the mold cavity and around the perimeter of the assembly, contacting the various components as described, and curing by polymeric reaction into the foam encased integrated structure. Other methods of formation of the foam encasement 600 can be employed, and the invention is not limited to any particular method or manner of combination of the described components.

With the integrated support structure thus formed, a foam topper 700 is placed on top of pad 180, and is preferably bonded thereto by a thermoplastic adhesive. Alternatively, the foam topper 700 can be placed in the described mold with the underlying insulator pad 180, innerspring 110 or flexible core and foam deck 200, and the foam encasement 600 formed or molded to bond the foam topper 700 to the other components by contact with the underside or sides of the foam topper 700.

In a preferred form, foam topper 700 is a sculpted foam topper with a sculpted or textured surface features 710 arranged over a primary support surface, and side rails 720 along the longitudinal sides of the topper, or ends, or about the entire perimeter. The foam topper 700 can be made of polyurethane or latex foam material of any suitable density.

Machine processing or water or laser cutting can be used to form any design of surface features 710, such as for example the six-sided tapered towers shown. The density of the foam topper 700 can be selected to produce a mattress or support device of any desired feel or support characteristic. The density may be selected with consideration of the stiffness of the innerspring, and the amount of dampening provided by the underlying foam deck. As a single unibody piece of foam, the topper 700 has the physical characteristics of a single type of foam with homogeneous foam cell structure, with the differing surface topographies altering the aggregate density and ultimate support characteristics of the zones defined by the sculpted area and rails. The sculpting of the support side of foam topper 700 is done by the removal of foam material in a pattern, such as the depicted matrix of valleys or voids with corresponding projections. The projections extend generally from the bottom of the valleys or voids so that it is the top or tip of the projections which collectively form a contoured support surface, over which an upholstery layer is laid. The solid form perimeter or rail sections provide a higher level of firmness than the contoured surface. Whereas a topper of uniform surface contour and density tends to become excessively compressed at the edge, which effectively reduces the usable sleeping area of a mattress, the density edge or rail zones maximize the support area of the mattress all the way to the edge of the encapsulated innerspring. As an alternative to a central sculpted zone with perimeter, laterally extending zones with varying topography can be formed to create a combination of varying support zones. The topography of the support surface of the foam topper 700 may also be formed to have gradual transitions between areas of differing topographies and corresponding densities. For example, in the case of a zone with a surface topography having multiple projections, which merges with a generally flat topography, the projections of the first zone can be made to decrease in height or depth as they approach the flat second zone, so that the transition in firmness is less perceptible when felt through the upholstery layers. In this same manner, multiple zones of differing density can be made in a single layer, with graduated transitions between the zones, so that the transitions from one foam density to another foam density are less perceptible through the overlying upholstery.

Figure 5:
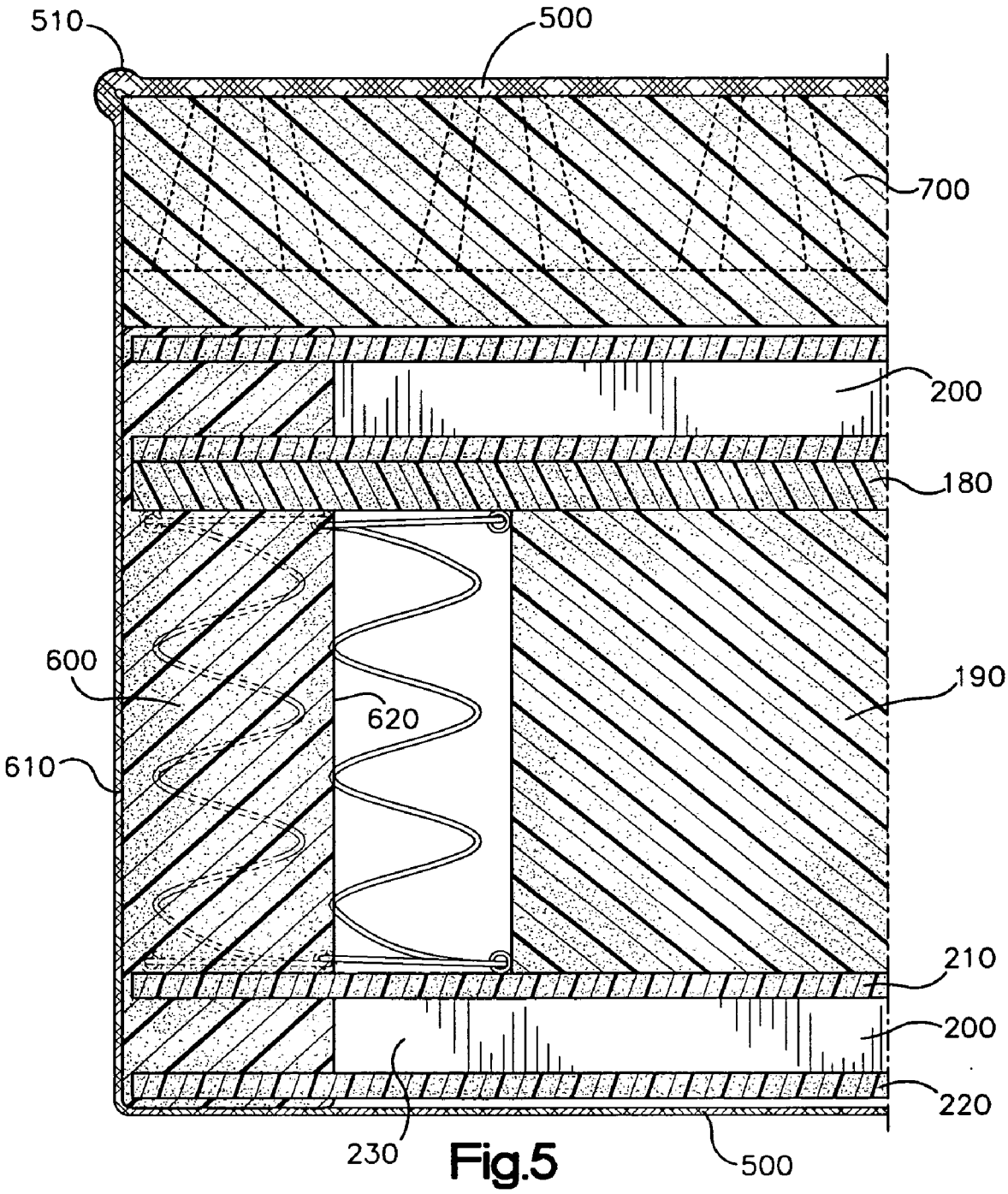
FIG. 5 is a cross-sectional view of an alternate embodiment of a structurally integrated foam encased support device of the invention.

Variations of the three primary support components; foam deck 200, innerspring 110 and foam topper 700, provide a wide range of design combinations to produce mattresses or support structures with widely varying comfort profiles of feel and performance. FIG. 5 illustrates an alternate embodiment of the invention wherein a second foam deck 200 is placed over the upper support surface 111 of the innerspring 110, above or below the insulator pad 180, and similarly structurally integrated by contact with the foam encasement 600.

As described in the related application, additional components can be thermally bonded with the foam deck 200 to form a unitized foam structure with additional foam pieces located at lateral edges of the innerspring 110, and which are thermally bonded or welded to the support surface 204 of foam deck 200. In these embodiments, the foam encasement 600 can still be utilized by application over the described additional foam components. Other foam components of various configurations can be attached to the major support surface of the foam deck 200 for contouring or structural strength as desired.

Different designs of innersprings and coils, including coils with different terminal configurations, such as the coils described in U.S. Pat. No. 5,713,088, with terminal convolutions of coils 120 in support contact with the upper surface 210 of foam deck 200, can be used in alternate embodiments of the invention.

Other foam components which interface with the coils of the innerspring can be used in conjunction with the foam deck 200 and/or foam encasement 600, such as foam pillars which are positioned within the coil bodies and extending generally perpendicular from the underlying or overlying foam decks 200, adding stiffness and support at desired locations, and working in cooperation with the foam topper 700.

The mattress 100 can of course be upholstered with material layer or layers 500, or quilted layers, which may include an underlayment of a padding and/or non-woven, and an outer upholstered material, which may be foam-backed, and closed with tape edges 510. The mattress can be made into virtually any upholstered mattress structure that is common to the art. The rigidity of the foam encasement provides the ideal form for the upholstery material 500, with smooth flat surfaces and well-defined corners over which the material can be pulled taut and secured. The well-defined corners of the edges of the foam encasement and foam topper provide an ideal guide and support for the overlying tape edges 510, resulting in very straight tape edges which gives the mattress a highly finished appearance.

What is claimed as the invention is:

1. A mattress comprising:

an innerspring having a plurality of spring elements arranged in an array and defining a first support side, a second support side parallel to the first support side, and a perimeter about the first and second support sides;

a foam deck adjacent one of the support sides of the innerspring, and a foam encasement about the innerspring and in contact with the foam deck and the innerspring, wherein the foam deck has first and second parallel and spaced apart panels and a web structure between the panels, and the foam encasement extends into the web structure.

2. The mattress of claim 1 further comprising a pad adjacent a support side of the innerspring opposite the foam deck.

3. The mattress of claim 2 further comprising a foam topper adjacent the pad.

4. The mattress of claim 3 wherein the foam topper is adhesively attached to the pad.

5. The mattress of claim 3 wherein perimeters of the foam deck and foam topper are aligned with a perimeter of the innerspring.

6. The mattress of claim 3 wherein the foam deck, innerspring, pad and foam topper are connected together by the foam encasement.

7. The mattress of claim 3 wherein the foam topper has a generally planar surface in contact with a support surface of the innerspring, and a sculpted surface facing away from the innerspring.

8. The mattress of claim 3 wherein the foam topper further comprises at least one side rail.

9. The mattress of claim 3 wherein the foam encasement extends under a perimeter area of the foam topper.

10. The mattress of claim 3 wherein the foam encasement contacts an underside of the foam topper which is in contact with a support surface of the innerspring.

11. The mattress of claim 3 further comprising at least one layer of padding adjacent the foam topper, and upholstery over the layer of padding.

12. The mattress of claim 2 wherein the foam encasement is in contact with the pad.

13. The mattress of claim 2 wherein the foam encasement forms an exterior wall which extends from the foam deck to the pad.

14. The mattress of claim 2 wherein the foam encasement is in contact with spring elements of the innerspring.

15. The mattress of claim 1 wherein the foam encasement is molded about the foam deck and innerspring.

16. The mattress of claim 1 further comprising at least one additional foam component.

17. The mattress of claim 16 wherein the additional foam component is in the form of a box beam.

18. The mattress of claim 1 further comprising a second foam deck adjacent a support side of the innerspring, and wherein the foam encasement is in contact with the second foam deck.

19. The mattress of claim 1 further comprising separate foam components engaged with the innerspring.

20. A resilient support structure comprising:

a flexible core having opposed planar sides and a perimeter which extends from one planar side to an opposite planar side;

a foam deck positioned under the flexible core adjacent one of the planar sides of the flexible core, the foam deck having first and second parallel and spaced apart panels and a web structure between the panels;

and a foam encasement which forms an exterior wall around a perimeter of the flexible core and extends into the web structure of the foam deck, and a foam topper positioned on top of the flexible core adjacent a planar side of the flexible core opposite the foam deck.

21. The resilient support structure of claim 20 wherein the foam encasement is molded about the foam deck and the flexible core.

22. The resilient support structure of claim 20 further comprising an insulator pad on one of the planar sides of the flexible core opposite the foam deck.

23. The resilient support structure of claim 22 wherein the foam encasement is attached to the foam deck, flexible core and insulator pad.

24. The resilient support structure of claim 22 wherein the foam topper is adjacent the insulator pad.

25. The resilient support structure of claim 24 wherein the foam topper has side rails and a sculpted support surface.

26. The resilient support structure of claim 24 wherein the foam topper is permanently bonded to the insulator pad.

27. The resilient support structure of claim 24 wherein a density of the foam topper is different than a density of the foam encasement.

28. The resilient support structure of claim 24 further comprising an upholstery layer over the foam topper.

29. The resilient support structure of claim 20 wherein the foam encasement is cured about the perimeter coils of the flexible core.

30. The resilient support structure of claim 20 wherein a density of the foam encasement is different than a density of the foam deck.

31. The resilient support structure of claim 20 in the form of a one-sided mattress with the foam deck located at a bottom of the mattress.

32. The resilient support structure of claim 20 wherein the foam topper comprises rails which are generally aligned with walls of the foam encasement.

33. A mattress core comprising:

a flexible core;

a foam deck which underlies the flexible core, wherein the foam deck has at least two spaced apart panels and a web structure between the panels;

an insulator pad which overlies the flexible core;

and a foam encasement which substantially surrounds a perimeter of the flexible core, foam deck and insulator pad and extends into the web structure of the foam deck.

34. The mattress core of claim 33 further comprising a foam topper on top of the insulator pad.

35. The mattress core of claim 34 wherein the foam encasement contacts the foam topper.

36. The mattress core of claim 34 wherein the foam topper is adhesively bonded to the insulator pad.

37. The mattress core of claim 33 wherein the flexible core is an innerspring.

38. The mattress core of claim 37 wherein the foam encasement is formed about coils of the innerspring.

39. The mattress core of claim 33 wherein the flexible core is a foam structure.

40. The mattress core of claim 33 wherein the insulator pad is formed of polyester fibers to which the foam encasement is bonded.

41. The mattress core of claim 33 wherein the insulator pad is a polyurethane pad to which the foam encasement is bonded.

* * * * *